US008800547B2

(12) United States Patent
Benedetti

(10) Patent No.: US 8,800,547 B2
(45) Date of Patent: Aug. 12, 2014

(54) REFRACTORY PANEL FOR A FIREPLACE

(75) Inventor: Joseph A. Benedetti, Nashville, TN (US)

(73) Assignee: Innovative Hearth Products LLC, Nashville, TN (US)

( * ) Notice: Subject to any disclaimer, the term of this patent is extended or adjusted under 35 U.S.C. 154(b) by 198 days.

(21) Appl. No.: 13/214,412

(22) Filed: Aug. 22, 2011

(65) Prior Publication Data

US 2012/0216798 A1 Aug. 30, 2012

Related U.S. Application Data

(60) Provisional application No. 61/446,939, filed on Feb. 25, 2011.

(51) Int. Cl.
*F24B 1/195* (2006.01)

(52) U.S. Cl.
USPC ..... 126/552; 126/529

(58) Field of Classification Search
USPC ..... 126/552, 519, 529, 530, 152 B, 152 R; 40/428; 52/27, 36.3
See application file for complete search history.

(56) References Cited

U.S. PATENT DOCUMENTS 6,050,011 A * 4/2000 Hess et al. ..... 40/428
7,322,819 B2 * 1/2008 Lyons et al. ..... 431/125

* cited by examiner

*Primary Examiner* — Alfred Basichas

(57) ABSTRACT

A refractory panel for a fireplace comprising interconnected sub-panels forming a textured surface. Adjacent ones of the sub-panels are partially separated from each other by gaps located between edges of the adjacent subpanels.

16 Claims, 6 Drawing Sheets

REFRACTORY PANEL FOR A FIREPLACE

CROSS-REFERENCE TO RELATED APPLICATION

This application claims the benefit of U.S. Provisional Application Ser. No. 61/446,939, filed by Joseph A. Benedetti et al. on Feb. 25, 2011, entitled "IMPROVED LINEAR FIREPLACE WITH BURNER," commonly assigned with this application and incorporated herein by reference.

TECHNICAL FIELD

This application is directed, in general, to fireplaces and, more specifically, to a refractory panel for a fireplace, and to a method of manufacturing the refractory panel.

BACKGROUND

A trend in prefabricated fireplace design has been a minimalist approach to the exterior of the fireplace, with a minimum of exposed metal outside the interior viewing area. Consequently, there is more emphasis on what is inside of the fireplace to create visual interest. Thus, decorative interior panels, interior lighting, loose media and logs have become more significant design features. It is important, however, for such features have a low production and operating costs, and have long durability.

SUMMARY

One embodiment of the present disclosure is a refractory panel for a fireplace. The panel comprises interconnected sub-panels forming a textured surface. Adjacent ones of the sub-panels are partially separated from each other by gaps located between edges of the adjacent subpanels.

Another embodiment is a fireplace, comprising walls defining an enclosed space and at least one opening, and a refractory assembly located inside of the enclosed space. The refractory assembly is positioned such that a textured surface of a refractory panel of the assembly can be viewed through the opening from outside of the fireplace. The refractory panel includes interconnected sub-panels forming the textured surface. Adjacent ones of the sub-panels are partially separated from each other by gaps located between edges of the adjacent subpanels.

Another embodiment of the present disclosure is a method of manufacturing a refractory panel. The method comprises forming a textured surface of interconnected subpanels wherein adjacent ones of the sub-panels are partially separated from each other by gaps located between edges of the adjacent subpanels.

BRIEF DESCRIPTION OF THE DRAWINGS

Reference is now made to the following descriptions taken in conjunction with the accompanying drawings, in which.

DETAILED DESCRIPTION

The term, "or," as used herein, refers to a non-exclusive or, unless otherwise indicated. Also, the various embodiments described herein are not necessarily mutually exclusive, as some embodiments can be combined with one or more other embodiments to form new embodiments.

Embodiments of the present disclosure provide a refractory panel for fireplaces which integrate decorative features and utility features. By integrating decorative features into the refractory panel, costs are eliminated or minimized compared to the separate fabrication and installation of decorative structures in the fireplace.

Figure 1:
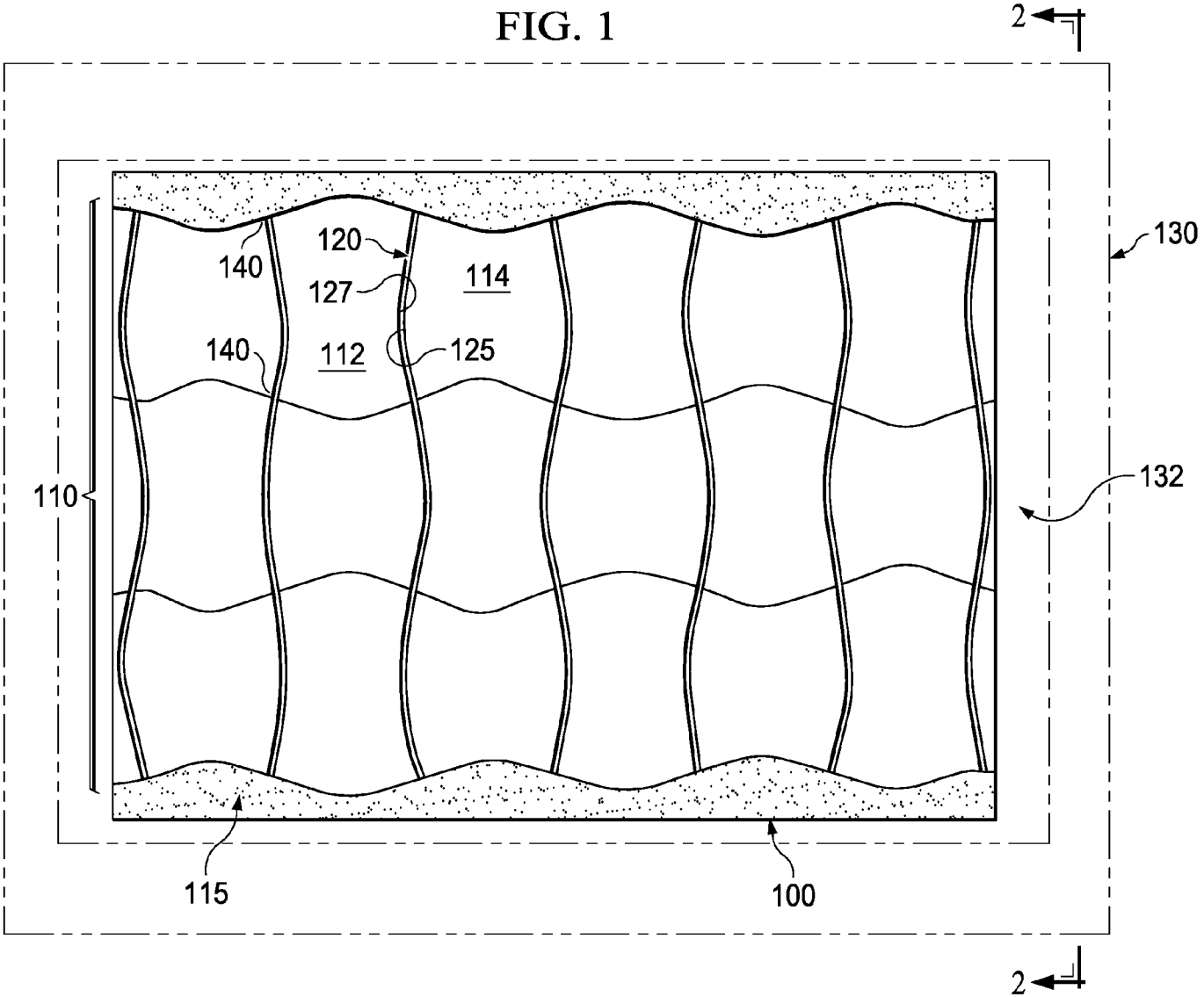
FIG. 1 presents a schematic front view of an example embodiment of a refractory panel of the disclosure.
Figure 2:
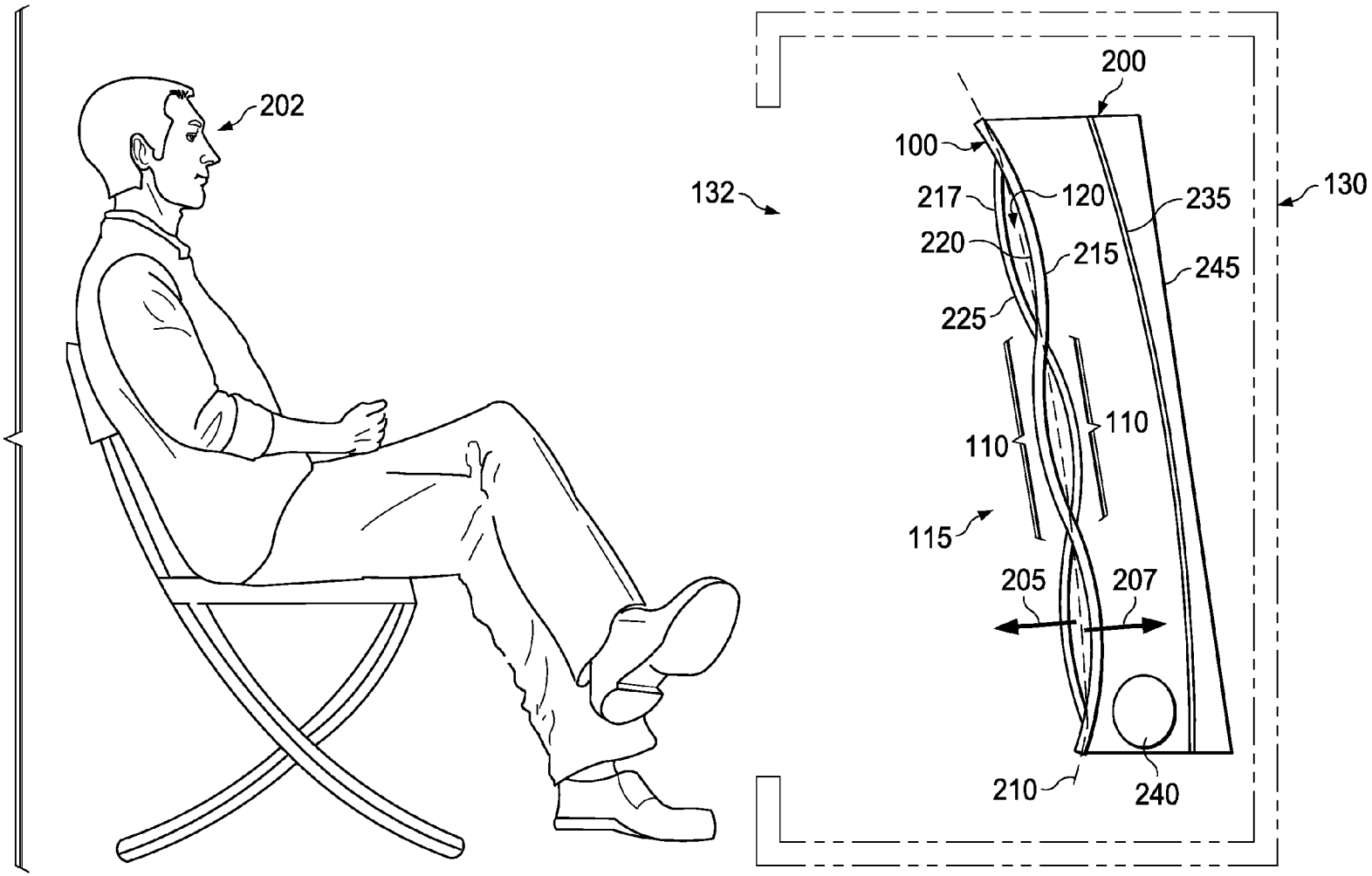
FIG. 2 presents a side view of the refractory panel of the disclosure, similar to that depicted in FIG. 1, along view line 2 in FIG. 1.

One embodiment of the present disclosure is a refractory panel for a fireplace. FIG. 1 presents a schematic front view of an example embodiment of a refractory panel 100 of the disclosure and FIG. 2 presents a side view of an example refractory panel 100 of the disclosure, similar to the panel 100 depicted in FIG. 1, along view line 2 in FIG. 1.

The panel 100 comprises interconnected sub-panels 110 forming a textured surface 115, wherein adjacent ones of the sub-panels 110 (e.g., sub-panels 112, 114) are partially separated from each other by gaps 120 located between edges 125, 127 of the adjacent subpanels 112, 114. In some cases adjacent subpanels 112, 114 are side-by-side. In other cases, (e.g., sometimes when the textured surface 115 form a three-dimensional surface) portions of the adjacent subpanels 112, 114 can overlap and can be separated by a gap 120 in the dimension that is perpendicular to the average plane 210.

The refractory panel 100, when installed in a fireplace 130, can facilitate the distribution and adjustment of visible light passing through the panel 100, and/or heat reflected off the panel and subsequently sensed by individuals in the vicinity outside of the fireplace 130. For instance, by increasing or decreasing the size of the gaps 120 more or less light or heat can be directed out of fireplace 130 opening 132. Similarly, adjusting the curvature of the sub-panels 110 or the curvature of the panel 100, can adjust the distribution and adjustment of visible light viewable, and/or heat from the fireplace 130.

The textured surface 115 is visible from outside of the fireplace 130 when the refractory panel 100 is installed in the fireplace 130. For instance, a viewing location 202 (FIG. 2) from which the textured surface 115 can be seen can be facing the opening 132 in a fireplace box 130. In some cases, the refractory panel 100 can be installed in a fireplace pit, or other fireplace structure, such that the textured surface 115 is visible from an opening in the fireplace.

In some embodiments the textured surface 115 is a two dimensional surface with the subpanels 110 and gaps 120 being entirely in a two-dimensional plane. In other embodiments, the textured surface 115 is a three-dimensional textured surface. For instance, portion of the subpanels 110 can protrude out from a plane or average plane of the panel 110 to provide the three-dimensional textured surface. For instance, as illustrated in FIG. 2, in some embodiments, portions of at least some of the subpanels 110 are bowed out in a direction 205, 207 that is substantially perpendicular to an average plane 210 of the refractory panel 100. In some cases, the bowed-out portions 215 of adjacent ones of the subpanels 112, 114 are bowed out in opposite directions 205, 207. For instance, in some cases the bowed-out portions 215 of the adjacent ones of the subpanels 112, 114 can form alternating concave and convex-shaped surfaces 220, 225 with respect to the viewing location 202 outside of the fireplace 130. In other cases, there can be more concave-shaped surfaces 220 facing the fireplace opening 132 than convex-shaped surfaces 225 facing the fireplace opening 132, e.g., to help direct more heat out of the opening 132. In still other cases, there can be more convex-shaped surfaces 225 than concave-shaped surfaces 220 facing the opening 132. Based on the present disclosure, one skilled in the art was appreciating that the surfaces 220 could have shapes other than concave or convex, and that the subpanels 112, 114 can have all the same size or different sizes. In some cases, for instance, subpanels 112, with convex-shaped surfaces 225 can be larger that subpanels 114 with concave-shaped surfaces 220, or, vice-versa in other cases.

In some cases, the textured surface 115 of the whole panel 100 has an arched shape. For instance, as shown in FIG. 2 the textured surface 115 can form a concaved-shaped arch (e.g., as defined by an arching average plane 210) with respect to a viewing location 132 outside of the fireplace 130. Such a configured can facilitate the projection of more heat out of the opening 132 of the fireplace. However, in other embodiments the textured surface can form a convex-shaped arch with respect to a viewing location, e.g., to facilitate the projection of less of heat out of the fireplace opening. Based on the present disclosure one of ordinary skill in the art would understand that the textured surface 115 could be configured to include other smooth or sharply angled curvatures.

As illustrated in FIG. 1 in some cases, to present a uniform visual appears, and in some cases, a uniform reflection of heat out of the opening, all of the subpanels 110 can have substantially the same area surface area (e.g., the areas of the subpanels forming the textured surface are all the same within 10 percent). However, in other cases, not all of the subpanels 110 have the same surface area.

Figure 3:
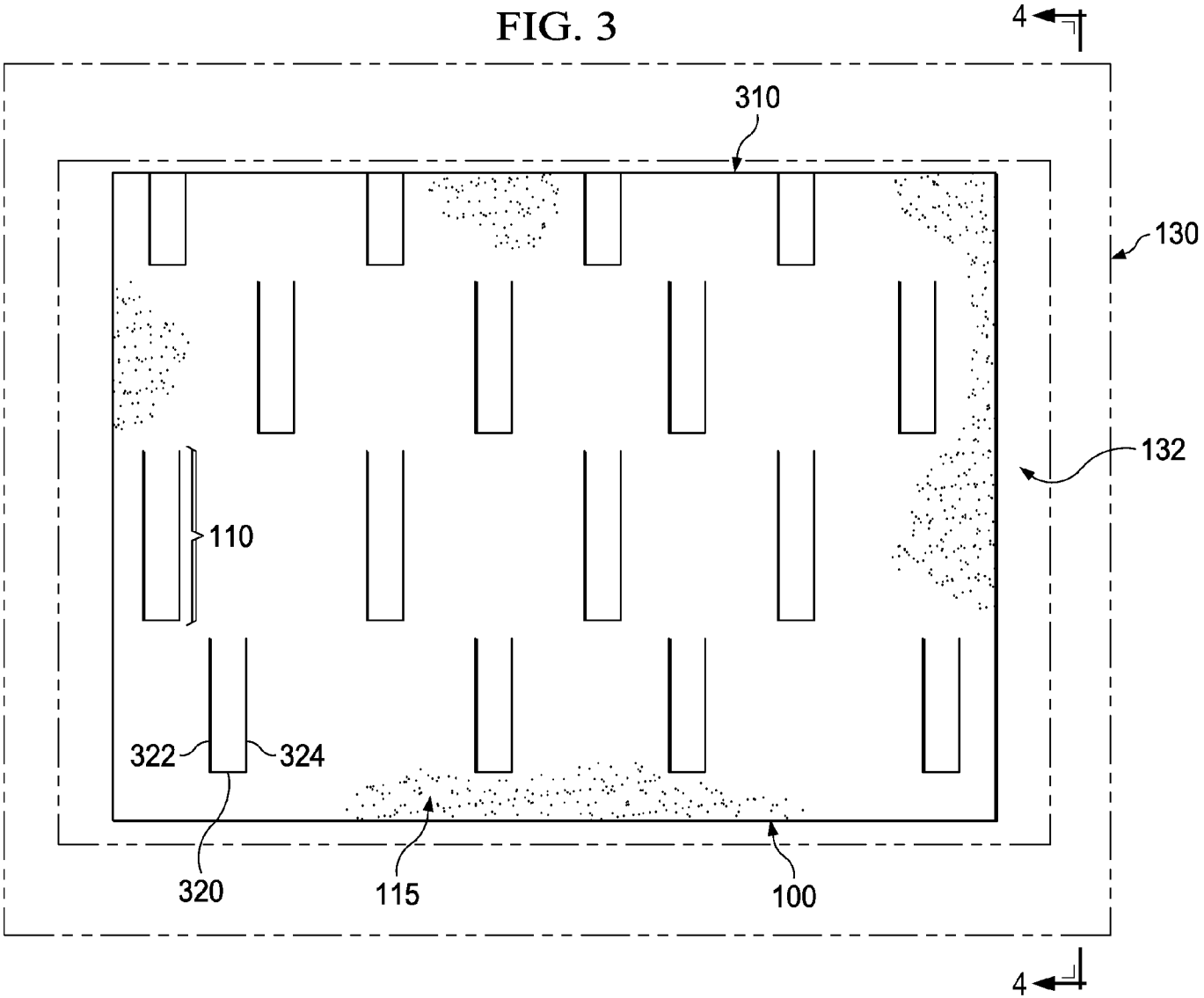
FIG. 3 presents a schematic front view of an alternative example embodiment of a refractory panel of the disclosure.
Figure 4:
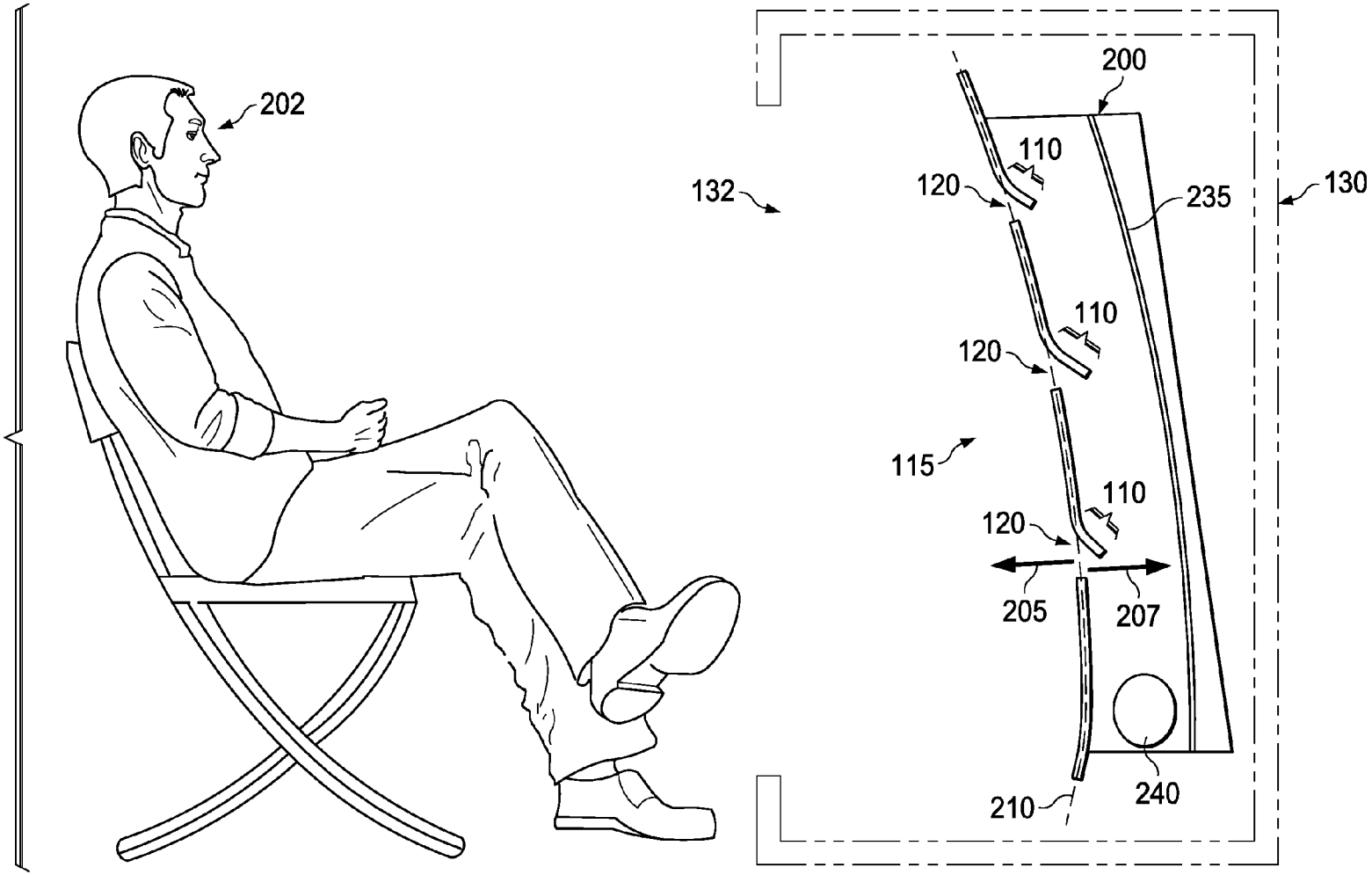
FIG. 4 presents a side view of the refractory panel of the disclosure, similar to that depicted in FIG. 3, along view line 4 in FIG. 3.

FIG. 3 presents a schematic front view of another an example embodiment of the refractory panel 100 of the disclosure and FIG. 4 presents a side view of the refractory panel of the disclosure, similar to the panel 100 depicted in FIG. 3, along view line 3.

For the embodiment shown in FIG. 3, the subpanels 110 are interconnected through a base structure 310 of the refractory panel 100. In some cases, the base structure 310 can be a planar base structure, while in other cases, the base structure 310 can have an arched shape (e.g., as defined by the average plane 210 shown in FIG. 4). As further illustrated in FIG. 3, three sides 320, 322, 324 of the subpanels 110 are separated from the planar base structure 310 by gaps 120 (FIG. 4). However, in other cases, there are only two sides (e.g., opposing sides 322 and 324) separated from the planar base structure 310 by gaps 120. In still other cases, a plurality of sides of multi-sided subpanels could be separated from the planar base structure by gaps. In some cases, as shown in FIG. 3, the same sides (e.g., bottom 320 and lateral sides 322, 324) of each of the subpanels 110 could be separated from the planar base structure 310 by gaps 120. However, in other cases, the different sides of different subpanels could be separated from the planar base structure.

As further illustrated in FIG. 4, in some embodiments, all of the subpanels 110 protrude in a same direction 410 that is substantially perpendicular with respect to the base structure 310. In other cases, however, some subpanels 110 protrude in one perpendicular direction 205 and other subpanels 110 protrude in an opposite perpendicular direction 207 with respect to the base structure 310.

In some embodiments of the panel 100, such as shown in FIGS. 1-4, the subpanels 110 are part of a single continuous sheet of refractory material, e.g., a continuous single sheet of steel or other refractory material form well known to those skilled in the art. In other cases however, the subpanels 110 can be separately formed pieces that are coupled together to form the panel 100. For instance, in some cases adjacent subpanels can be welded together at their opposing edges or to a common base structure. For instance, in some cases opposing edges of adjacent ones of the subpanels are hinged together. E.g., edges of the subpanels can be interlocked with a pin or interlaced without a pin, so that the subpanels can are movable with respect to each other. Having subpanels 110 that are hinged together can be independently moved and angled with respect to each can facilitate the installation of the refractory panel 100 in an existing fireplace 130. Having hinged subpanels 110 can also facilitate forming different types of curvature in the textured surface 115, e.g., to adjust the distribution of heat and light reflection off of the textured surface 115 as well as the amounts of light and heat passing through the gaps between subpanels 110.

As further illustrated in FIG. 2, in some embodiments, the refractory panel 100 is part of a refractory assembly 200 that can further include one or both of a light reflecting panel 235 located behind (relative to the viewing location 132 of the fireplace 130) the refractory panel 100 and an illumination source 240 located behind the refractory panel 100, and in some cases, between the refractory panel 100 and light reflecting panel 235. In some cases, the assembly 200 can include a housing 245 that holds the refractory panel 100, light reflecting panel 235, and illumination source 240 at fixed positions relative to each other.

Figure 5:
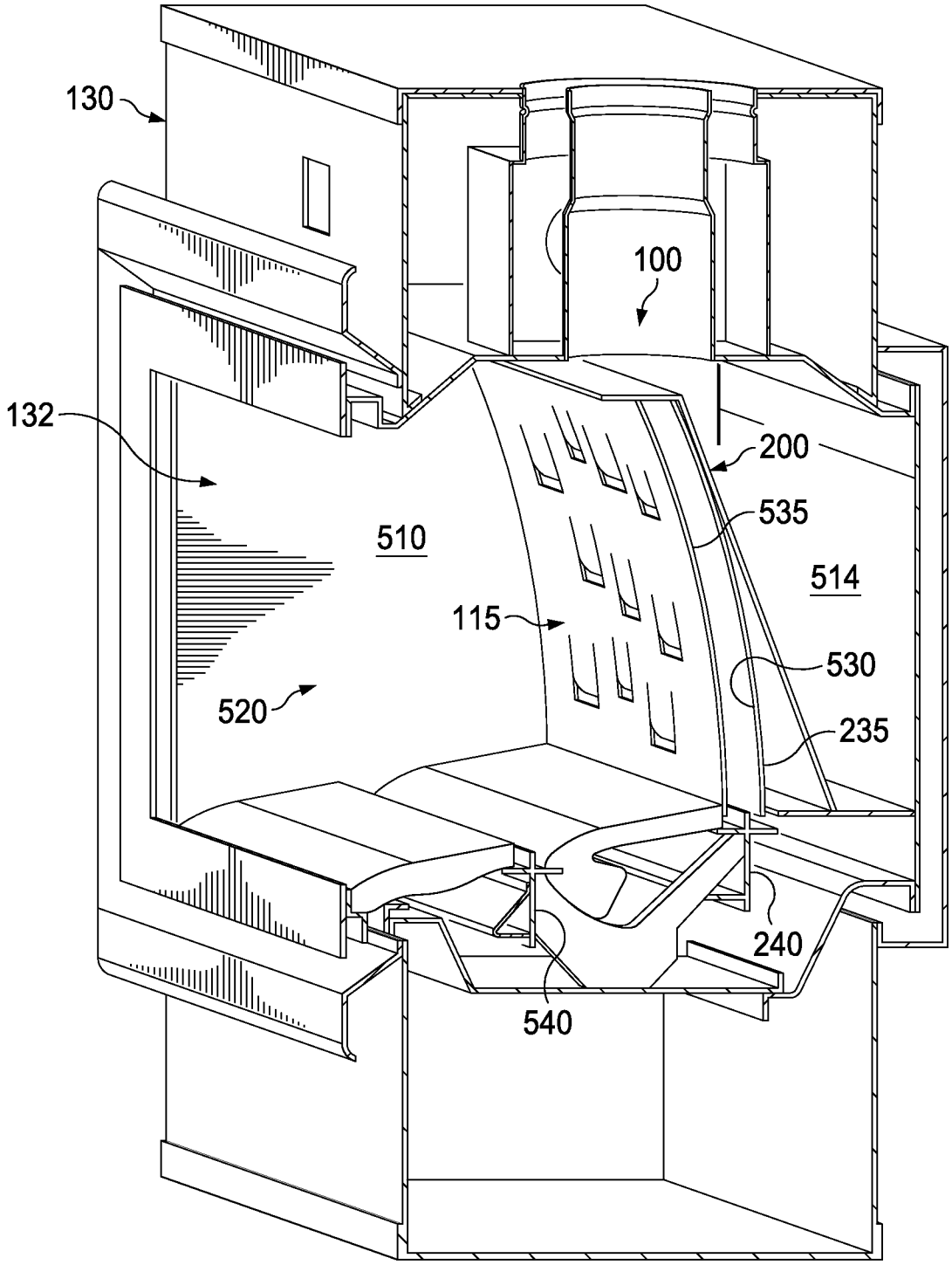
FIG. 5 presents a cut-away perspective view of an example embodiment of selected portions of a fireplace of the disclosure, the fireplace including the disclosed refractory panel, including any of the embodiments discussed in the context of FIG. 1-4.

Another embodiment of the disclosure is a fireplace that includes the refractory panel of the disclosure. FIG. 5 presents a cut-away perspective view of an example embodiment of selected portions of a fireplace 130 of the disclosure.

The fireplace 130 comprises walls (e.g., side walls 510, rear wall 514) defining an enclosed space 520 and at least one opening 132. The fireplace 130 also comprises a refractory assembly 200 located inside of the enclosed space 520, and, positioned such that a textured surface 115 of the refractory panel 100 of the assembly 200 can be viewed through the opening 132 from outside of the fireplace 130. The refractory panel 100 can include any of the embodiments discussed in the context of FIG. 1-4. For instance, the panel 100 includes interconnected sub-panels 110 forming the textured surface 115 and adjacent ones of the sub-panels 112, 114 are partially separated from each other by gaps 120 located between edges 125, 127 of the adjacent subpanels 112, 114 (FIG. 1).

As illustrated in FIG. 5, in some embodiments, the refractory panel 100 (and assembly 200) is adjacent to a rear wall 514 of the fireplace 130. However in other embodiments, the refractory panel 100 or, in some cases, multiple refractory panels 100, could be each adjacent to the side walls 510.

As illustrated in FIG. 5, in some embodiments, the refractory assembly 200 further includes an illumination source 240 located behind (relative to the opening 132 and viewing location 202, FIG. 2) the refractory panel 100. The illumination source 240 can facilitate visual highlighting of the textured surface 115, e.g., by providing back illumination respect to the viewing location 202 (FIG. 2). In some cases, the illumination source 240 can be a low-BTU illumination burner (e.g., the burner capable of maximally giving off 7000 BTUs or less of heat, and in some cases, less than 5000 BTUs, and still other cases, heat in a range from 5000 to 7000 BTU). In other cases, the illumination source 240 can be an incandescent light source (filament-type bulbs or neon light) or a light emitting diode. In still other cases, illumination source 240 can include a combination of one or more of a low-BTU illumination burner, incandescent light source or light emitting diode.

As illustrated in FIG. 5, in some embodiments, the refractory assembly 200 includes a light reflecting panel 235 positioned behind (relative to the opening 132 and viewing location 202, FIG. 2) the refractory panel 100. The light reflecting panel 235 can facilitate the highlighting of the textured surface 115, e.g., by reflecting the back-illumination from the illumination source 240 and/or reflecting light coming from in front of the textured surface 115 and passing through the gaps 120 in the textured surface 115. In some cases, it is preferable for a surface 530 of the refractory panel 100 that opposes a rear surface 535 of the refractory panel 100 to have a translucent finish (e.g., a coating of white enamel porcelain paint) or a diffuse reflective finish (e.g., brushed stainless steel finish). Having a translucent finish or diffuse reflective surface can facilitate the uniform distribution of the light being reflected off of the light reflecting panel 235 and through the gaps 120 in the textured surface 115.

In some cases, the surface 535 of the refractory panel 100 that opposes the light reflecting panel 235 includes a diffuse reflective finish or a translucent finish, to facilitate reflecting light not passing through the gaps 120 (FIGS. 1-3) to reflect back off of the light reflecting panel 235 and out through the gaps 120 towards the viewing location 202.

As also illustrated in FIG. 5, some embodiments of the fireplace 130 can further include an illumination source 540 located in front of (relative to the opening 132 and viewing location 202) the refractory panel 100. In some cases, the front illumination source 530 can be the primary heat source of the fireplace 130, such as provided by a high BTU burner assembly 535 (e.g., a burner capable of putting 7000 BTUs or higher, e.g., 30,000 or 60,000 BTUs), while in other cases, the illumination source 540 can be or further include an incandescent light source and/or LED sources.

Figure 6:
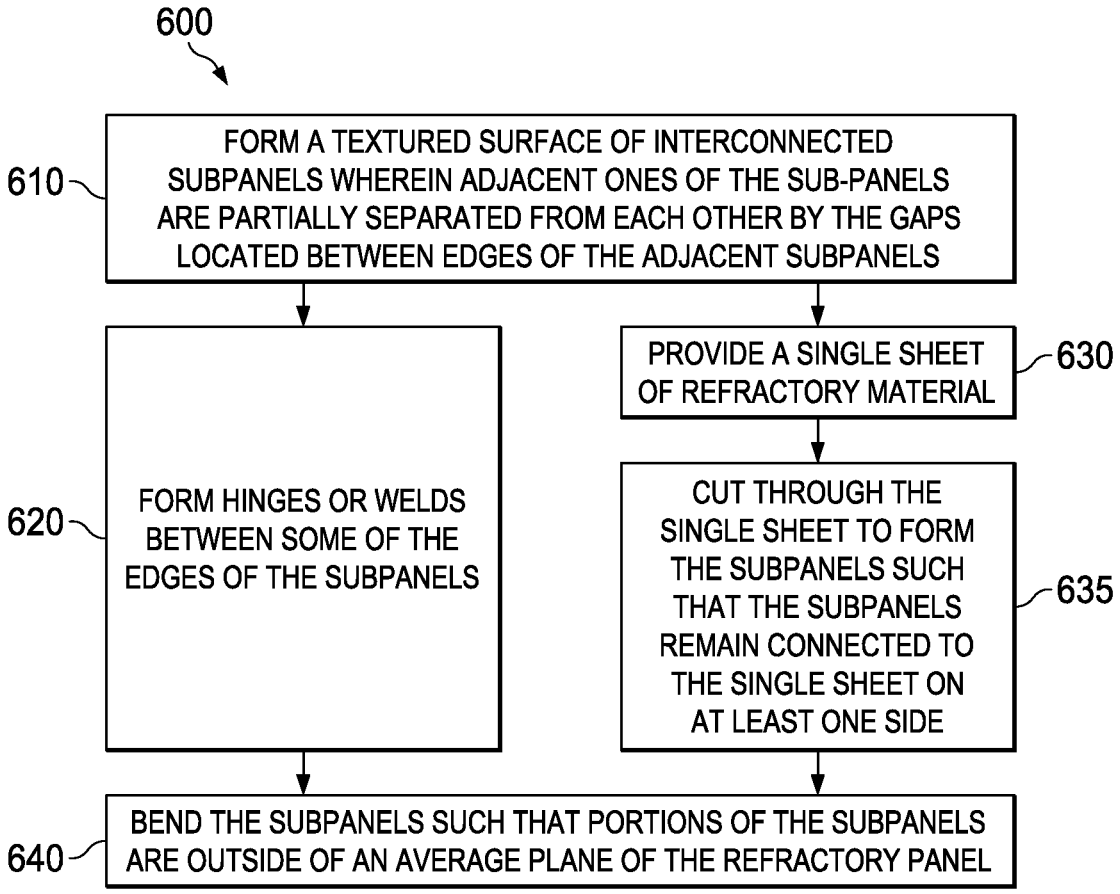
FIG. 6 presents a flow diagram of an example method of manufacture which includes fabricating a refractory panel, including any of the example embodiments discussed in the context of FIGS. 1-5.

Another embodiment of the present disclosure is a method of manufacturing a refractory panel, such as any of the refractory panels 100 discussed in the context of FIGS. 1-5. FIG. 6 presents a flow diagram of an example method 600 of manufacture.

With continuing reference to FIGS. 1-5 throughout, the example method 600 comprises a step 610 of forming a textured surface 115 of interconnected subpanels 110 wherein adjacent ones of the sub-panels (e.g., panels 112, 114) are partially separated from each other by the gaps located between edges (e.g., edges 125, 127) of the adjacent subpanels 112, 114.

In some embodiments, forming the textured surface 115 of interconnected subpanels 110 (step 610) can include a step 620 of forming hinges or welds between some of the edges of the subpanels.

In other embodiments, forming the textured surface 115 of interconnected subpanels 110 (step 610) can include a step 630 of providing a single sheet of refractory material (e.g., a steel sheet) and a step 635 of cutting through the single sheet to form the subpanels 110 such that the subpanels remain connected to the single sheet on at least one side. In some embodiments, for example, the single sheet is cut, as part of step 635, using a laser or other metal cutting tool. One of ordinary skill would understand that the sub-panels 112, 114 after step 635 remain interconnected to each other either directly or through a base structure 310 such as depicted in FIG. 3. For example, in some cases such as shown in FIG. 1, one or more corner portions 140 of the subpanels 112 can remain connected to adjacent subpanels 114, e.g., by not cutting the single sheet corresponding to the corner portion 140.

Certain embodiments of the method 600 can further include a step 640 of bending the subpanels 110 such that portions 215 of the subpanels 110 are outside of an average plane 210 of the refractory panel 200 to thereby configure the textured surface 115 as a three-dimensional textured surface.

In some cases the subpanels 110 can be individually bent in step 640 prior to coupling the subpanels 110 together in step 620. In other cases bending the subpanels 110 in step 640 further includes placing the cut single sheet (e.g., the single sheet after step 635) into a floating die and selectively bending portions of the sheet such that the portions 215 of the subpanels 110 are outside of an average plane 210.

Those skilled in the art to which this application relates will appreciate that other and further additions, deletions, substitutions and modifications may be made to the described embodiments.

What is claimed is:

1. A refractory panel for a fireplace, comprising:

interconnected sub-panels forming a textured surface, wherein adjacent ones of each of the sub-panels are partially separated from each other by gaps located between edges of each of the adjacent subpanels and located within an outer perimeter of the planar or arched-shaped refractory panel, wherein the gaps allow the passage of visible light through the planar or arched-shaped refractory panel.

2. The panel of claim 1 wherein the textured surface is a three-dimensional textured surface.

3. The panel of claim 1, wherein portions of the subpanels are bowed out in a direction perpendicular to an average plane of the refractory panel such that the bowed-out portions of adjacent ones of the subpanels are bowed out in opposite directions.

4. The panel of claim 3, wherein the bowed-out portions of adjacent ones of the subpanels form alternating concave and convex shaped surfaces with respect to a viewing location outside of the fireplace.

5. The panel of claim 1, wherein the textured surface is arched with respect to a viewing location outside of the fireplace.

6. The panel of claim 1, wherein the subpanels are interconnected through a base structure.

7. The panel of claim 1, wherein the subpanels are part of a single continuous sheet of refractory material.

8. The panel of claim 1, wherein opposing edges of adjacent ones of the subpanels are subpanels hingedly connected.

9. The panel of claim 1, wherein the refractory panel is part of a refractory assembly that further includes one or both of a light reflecting panel located behind the refractory panel and illumination source located behind the refractory panel and in some cases between the refractory panel and light reflecting panel.

10. A fireplace, comprising:

walls defining an enclosed space and at least one opening; and a refractory assembly located inside of the enclosed space and including a refractory panel, the refractory panel positioned such that a textured surface of the refractory panel can be viewed through the opening from outside of the fireplace, the refractory panel including:

interconnected sub-panels forming the textured surface, wherein adjacent ones of each of the sub-panels are partially separated from each other by gaps located between edges of each of the adjacent subpanels and located within an outer perimeter of the planar or arched-shaped refractory panel, wherein the gaps allow the passage of visible light through the planar or arched-shaped refractory panel.

11. The fireplace of claim 10, wherein the refractory panel is adjacent to one of the walls that is a rear wall.

12. The fireplace of claim 10, wherein the refractory assembly further includes an illumination source located behind the refractory panel.

13. The fireplace of claim 12, wherein the illumination source includes a low-BTU illumination burner.

14. The fireplace of claim 10, wherein the refractory assembly further includes a light reflecting panel positioned behind the refractory panel.

15. The fireplace of claim 14, wherein a surface of the refractory panel that opposes the light reflecting panel includes a diffuse reflective finish or a translucent finish.

16. The fireplace of claim 10, further includes an illumination source located in front of the refractory panel.

* * * * *